US005186376A

United States Patent [19]

Scharf et al.

[11] Patent Number: 5,186,376

[45] Date of Patent: Feb. 16, 1993

[54] PLASTIC WRAP DISPENSER

[75] Inventors: James E. Scharf, Perdue; Orville Olm, Saskatoon, both of Canada

[73] Assignee: Jim Scharf Holdings Ltd., Perdue, Canada

[21] Appl. No.: 673,187

[22] Filed: Mar. 21, 1991

[51] Int. Cl.[5] ..... B65H 35/00; B65D 85/672

[52] U.S. Cl. ..... 225/42; 225/47; 225/80; 225/90; 225/91

[58] Field of Search ..... 225/42, 46, 47, 48, 225/77, 80, 90, 91, 39; 242/55.3, 55.53; 30/349; 83/649

[56] References Cited

U.S. PATENT DOCUMENTS

| | | | |
|---|---|---|---|
| 3,144,184 | 8/1964 | Yerkes | 225/47 X |
| 3,236,427 | 2/1966 | Martin | 83/649 X |
| 3,273,773 | 9/1966 | Eder | 225/42 X |
| 3,311,278 | 3/1967 | Brandon | 225/93 |
| 3,370,497 | 2/1968 | Busse | 83/649 X |
| 4,002,238 | 1/1977 | Cameron et al. | 242/55.53 X |
| 4,095,730 | 6/1978 | Clatterbuck | 225/80 X |
| 4,191,307 | 3/1980 | LeCaire, Jr. et al. | 242/55.53 X |
| 4,607,774 | 8/1986 | Garr | 225/77 X |
| 4,659,028 | 4/1987 | Wren | 242/55.53 X |
| 4,772,355 | 9/1988 | Leahy | 225/39 X |
| 4,779,780 | 10/1988 | Scharf | 242/42 |
| 4,817,798 | 4/1989 | Huang | 225/48 X |
| 4,832,271 | 5/1989 | Geleziunas | 242/55.53 |
| 4,898,312 | 2/1990 | Hwang | 225/47 X |

FOREIGN PATENT DOCUMENTS

| | | | |
|---|---|---|---|
| 2367012 | 6/1978 | France | 225/42 |
| 0364714 | 11/1962 | Switzerland | 225/42 |
| 2011854 | 7/1979 | United Kingdom | 225/42 |

*Primary Examiner*—Frank T. Yost
*Assistant Examiner*—Clark F. Dexter
*Attorney, Agent, or Firm*—Murray E. Thrift; A. D. Battison; Stanley G. Ade

[57] ABSTRACT

A dispenser is used for dispensing plastic film from a roll. The dispenser has a housing that may be mounted under a shelf or cupboard or on a wall. The housing consists of a cover unit that is installed in the place of use and a releasable base unit that fits into the bottom of the cover unit and is held in place with resiliently biased locking tabs. The base unit carries the roll of film, so that the roll is readily installed on the base unit when separated from the cover. The loaded base unit is easily lifted into place. The film is dispensed through a dispensing slot at the back of the base unit. Lengths of film are severed using a cutter at the front of the base unit. The length of film between the dispensing opening and the cutter is prevented from clinging to the underside of the base unit by using a non-planar, roughened surface on the under side of the base plate. The non-planar aspect of the surface is preferably provided by a series of ribs and a sandblasted surface texture to provide the desired non-planar, roughened surface.

14 Claims, 4 Drawing Sheets

PLASTIC WRAP DISPENSER

FIELD OF THE INVENTION

The present invention relates to new and useful improvements in dispensers for plastic film wrap.

BACKGROUND

In Canadian Patent 1275980 issued Nov. 6, 1990 to James E. Scharf, a co-inventor in this application, there is disclosed a plastic film dispenser in which a roll of film is housed within a box-like container and dispensed through a slot in the container base, adjacent the back of the base. Lengths of film are cut off using a cutter blade on the base, adjacent the front. To prevent film from adhering to the underside of the container, between the slot and the cutter blade, the base is covered with a layer of vinyl plastic, a material that has only limited static attraction properties with respect to the film.

The manufacture of the prior metal container, using a metal housing with a metal base plate covered with a separate vinyl layer is relatively expensive, especially where the product is intended for household use. In addition, the use of a front cover that pivots upwardly about a hinge for roll replacement may be difficult to use, especially where the roll being placed in the container is rather heavy.

The present invention is concerned with one or more improvements in such a dispenser.

SUMMARY

According to one aspect of the present invention there is provided a dispenser comprising a container for housing a roll of plastic film, the container having a base with spaced front and rear sides, a dispensing slot adjacent the rear side of the base and a film cutter adjacent the front side of the base and roll mounting means for mounting a roll of film in the container such that an end of the film may be withdrawn from the container through the dispensing slot and drawn across the base of the container for engagement with the cutter wherein the base has a textured, non-planar bottom surface between the dispensing slot and the cutter.

The base may be a unitary, uncovered base plate with ribs and a sand-blasted, rough texture that provides significant surface to surface contact with the film. This allows the base to be made of a wide variety of materials, regardless of its cling properties. It is preferred to make the base as a single molded thermoplastic unit.

According to one another aspect of the present invention there is provided a dispenser for plastic film comprising:

a base unit;

roll mounting means for mounting a roll of plastic film on the base unit;

a cover unit having an open bottom for receiving the roll mounting means and a roll supported thereby, the open bottom being engageable with the top of the base unit; and latch means responsive to movement of the base unit upwardly into engagement with the open bottom of the cover unit for latching the cover unit and the base unit together.

The roll of film may conveniently be mounted on the base unit, and the unit and film roll raised together into the bottom of the cover, making the reloading procedure much more convenient than with prior art dispensers.

With a plastic cutter on a reusable dispenser, the cutter may dull over time. Consequently, the apparatus may be equipped with a removable and replaceable cutter.

Thus, according to another aspect of the present invention there is provided a dispenser for plastic film comprising:

a housing for containing a roll of plastic film;

a dispensing opening along one side of the housing;

an elongate cutter; and means detachably mounting the cutter on the housing parallel to the dispensing opening for removal and replacement of the cutter.

In preferred embodiments the cutter comprises a channel that is a friction or snap fit onto a flange on the housing. The flange may itself constitute a cutter over which the replacement cutter is installed when the original becomes dull. Cutters can be supplied with rolls of film to ensure that an effective cutter is always at hand.

BRIEF DESCRIPTION OF THE DRAWINGS

In the accompanying drawings, which illustrate an exemplary embodiment of the present invention.

DETAILED DESCRIPTION

Figure 1:
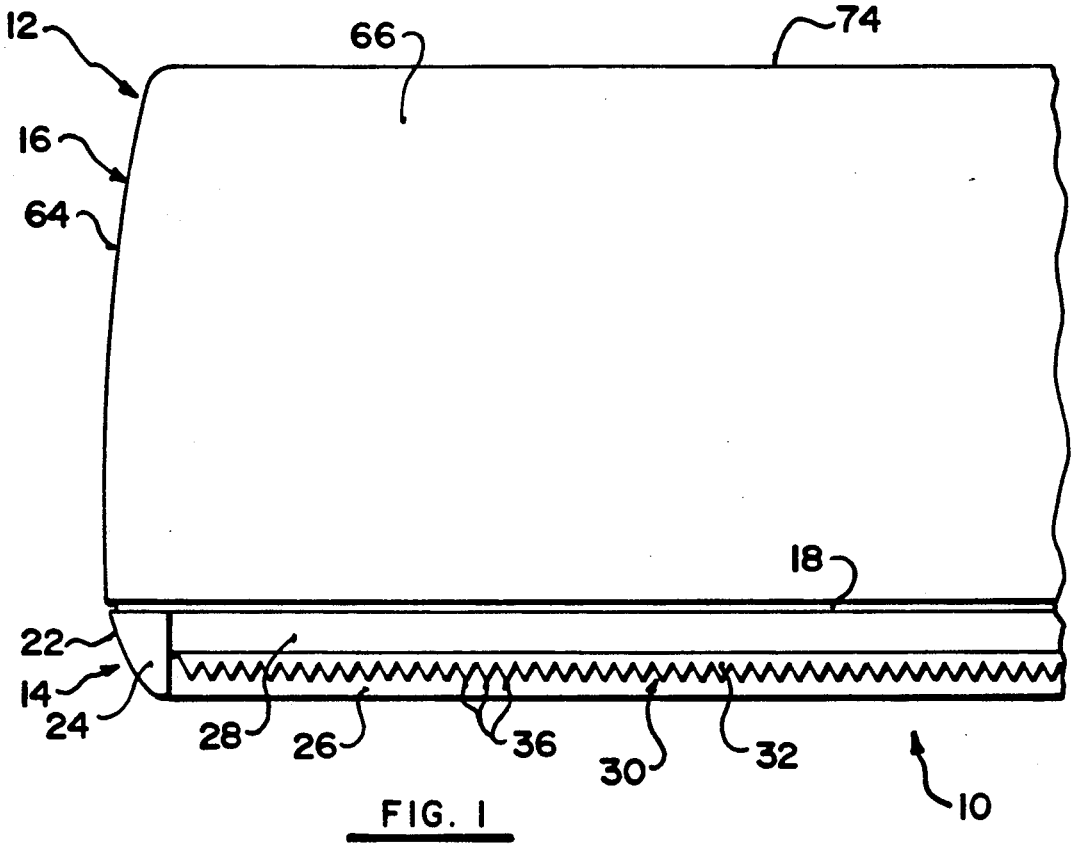
FIG. 1 is a fragmentary front elevation of a dispenser according to the present invention.
Figure 2:
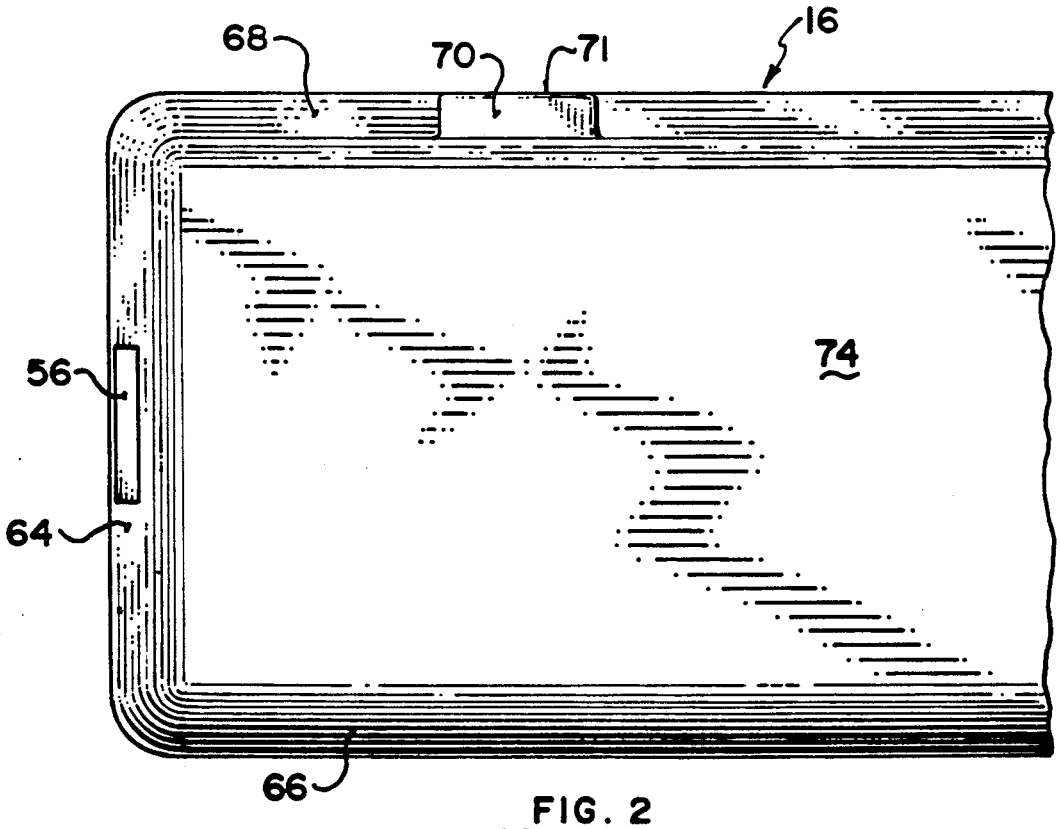
FIG. 2 is a fragmentary plan view of the dispenser.
Figure 3:
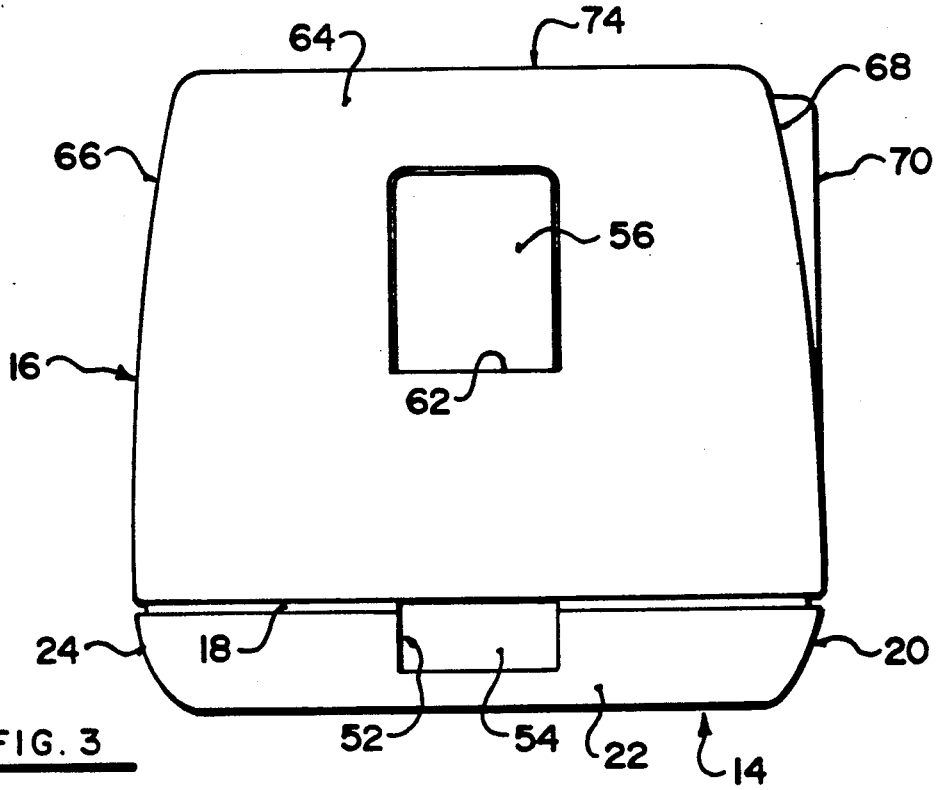
FIG. 3 is an end elevation of the dispenser.

Referring to the accompanying drawings, there is illustrated a dispenser 10 for plastic film. The dispenser has a container 12 consisting of a base unit 14 and a cover unit 16. The two meet at a horizontal, peripheral joint 18.

The base unit has a back wall 20 that curves downwardly towards the front. Two end walls 22 at each end are similarly shaped. A short front wall segment 24 is provided at each end of the base unit, adjacent the end wall 22.

Between the front wall segments 24 is a front recess 26 bounded on the back by a rearwardly sloping flat plate 28. At the back of the plate 28 is a film cutter 30 with a flat front face 32, and a back face 34 that slopes downwardly to meet the front face 32 at an acute angle. The cutter extends from end to end of the recess 26 and has a series of v-shaped teeth 36 formed along each sharp bottom edge. The cutter teeth terminate slightly above the bottom of end walls 22 and back wall 20. The cutter is continued upwardly from the back edge of the plate 28 to form a vertical front flange 38.

Along the front of the back wall 20 is a vertical flange 40. Similar vertical flanges 42 extend upwardly from the bottom edge of the end walls 22. A base comprising a horizontal base plate 44 is bounded on the front by the flange 38 and on the ends by flanges 42. Between the back of the base plate 44 and the flange 40 is a dispensing opening 46 for dispensing plastic film wrap. Along the back edge of the base plate 44 is a rib 47 that stiffens this edge. This rib is rounded and provides low frictional resistance to the dispensing of wrap.

The bottom surface 48 of the base plate 44 has an uneven configuration provided by a series of ribs 50 that extend in cross section. The bottom surface 48 is also provided with a rough texture, for example by sandblasting the mold in which it is formed.

Each end wall 22 of the base unit 14 has a rectangular end opening 52. Inside this opening is a vertical tongue 54 that carries, at its upper end, a locking tab 56 which serves to connect the base unit to the cover as will be described in more detail in the following.

Figure 4:
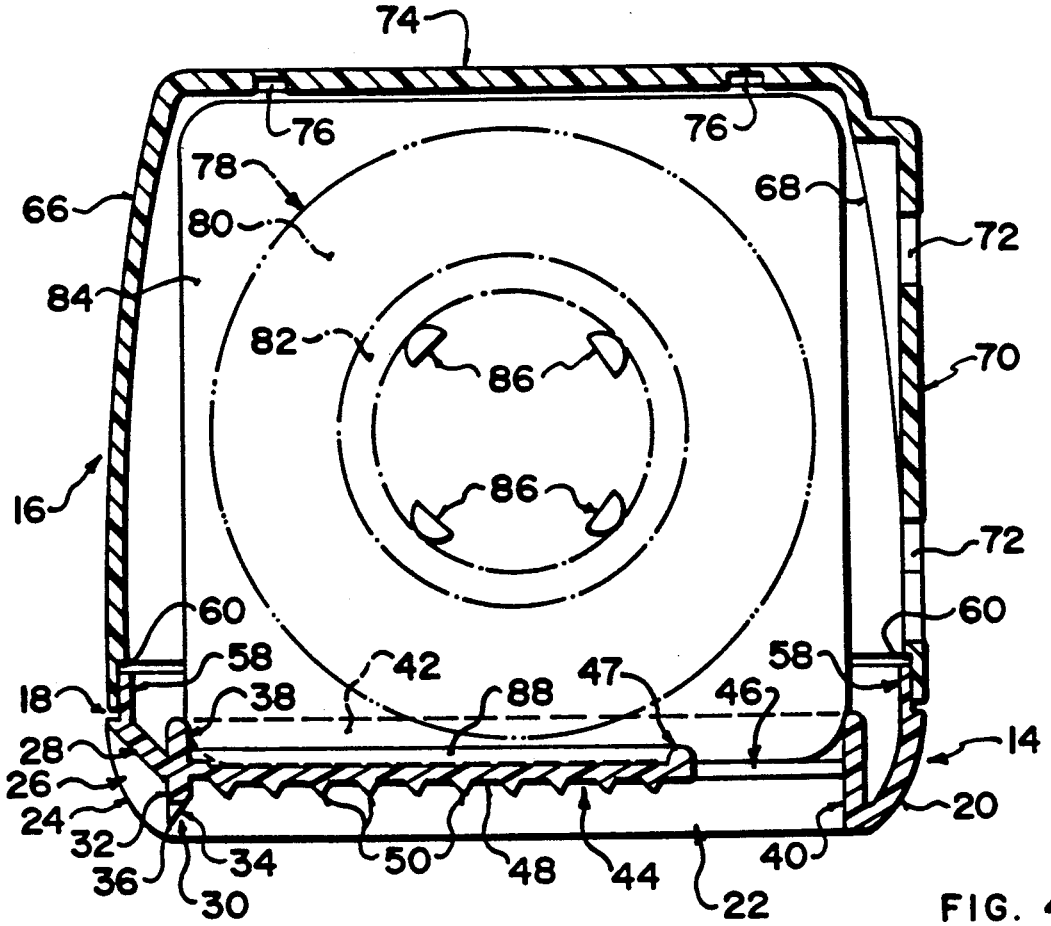
FIG. 4 is a transverse cross section of the dispenser.
Figure 5:
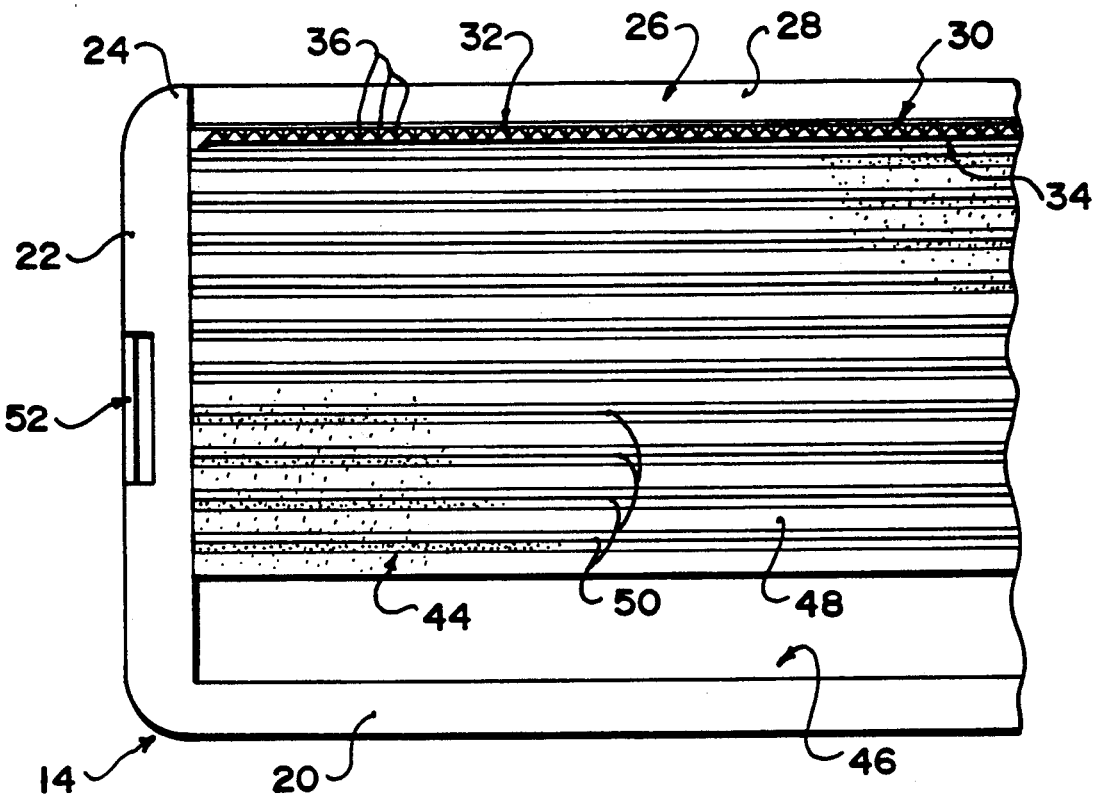
FIG. 5 is a fragmentary bottom view of the dispenser.
Figure 6:
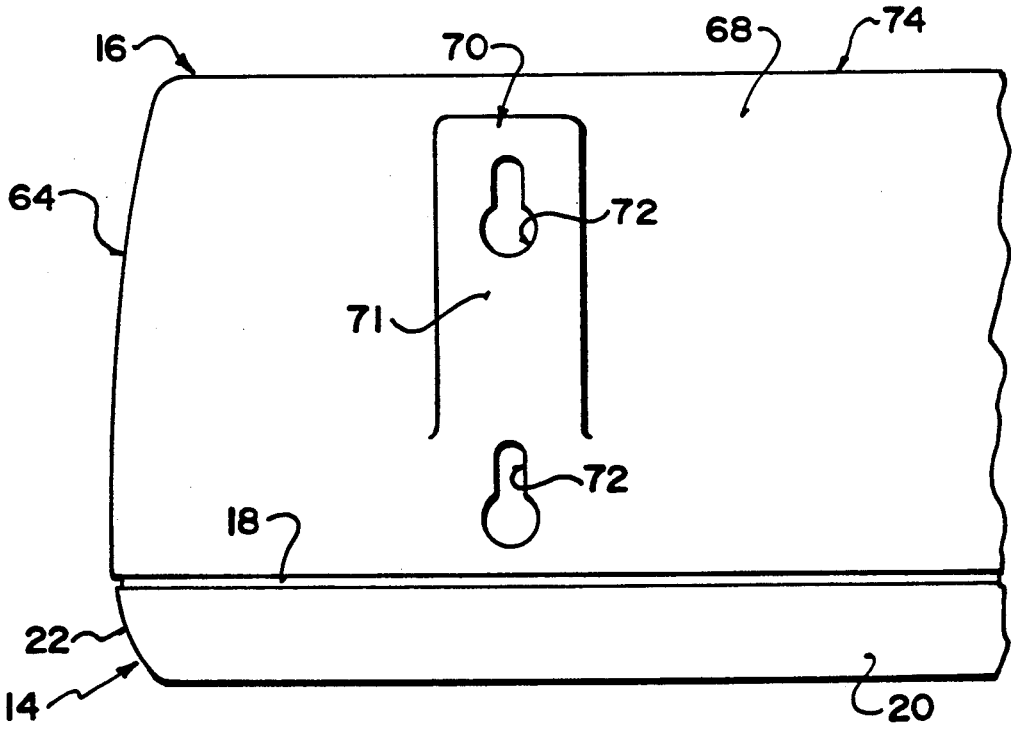
FIG. 6 is a fragmentary back elevation of the dispenser.
Figure 7:
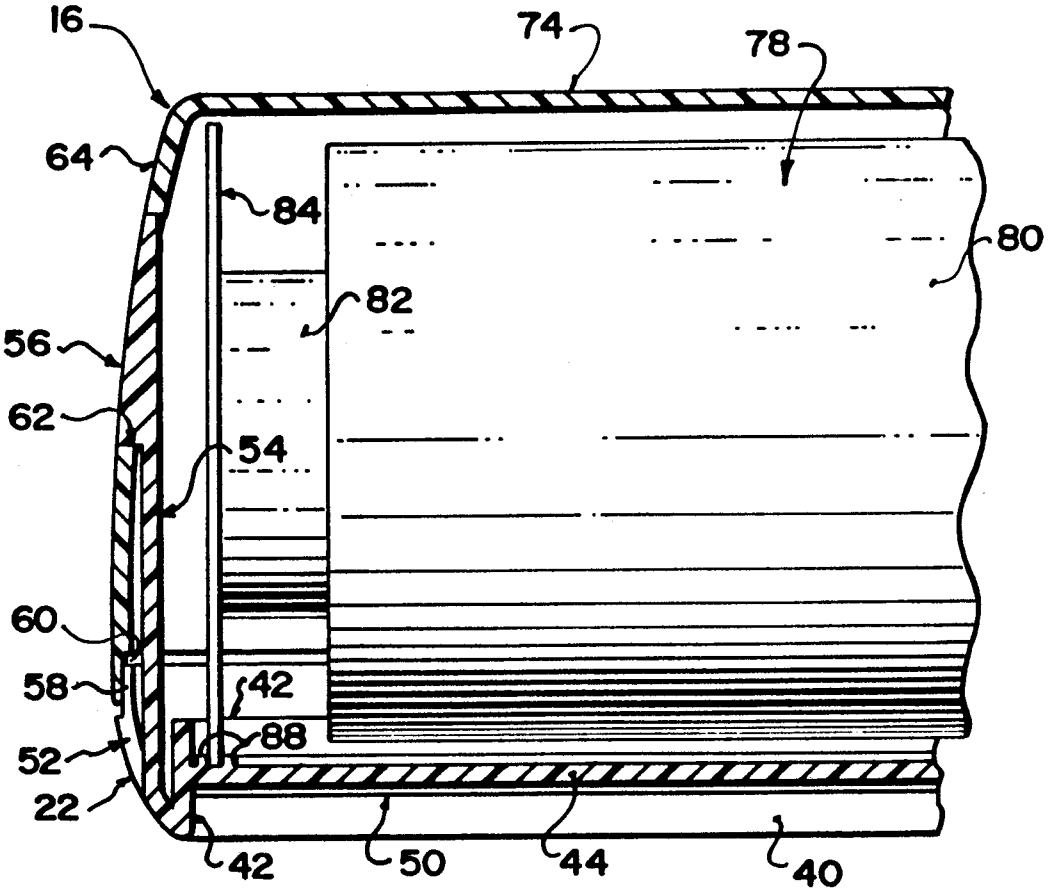
FIG. 7 is a fragmentary longitudinal cross section of the dispenser.

As illustrated most particularly in the cross sectional views of FIGS. 4 and 7, the bottom unit has an inwardly recessed upper flange 58 that engages in an internal recess 60 at the bottom edge of the cover unit, thus properly locating the units with respect to one another when joined.

The cover and base unit together are held by latches including the locking tabs 56 of the base unit tongues 54 engaging in openings 62 in the end walls 64 of the cover unit. The outer faces of the locking tabs are contoured to match the contours of the upwardly and inwardly curving end walls of the cover unit.

The cover unit has a front wall 66 that curves upwardly to the rear and a back wall 68. The back wall is shaped similarly to the front wall but has a pair of wide ribs 70 that present vertical back faces 71 provided with keyhole mounting slots 72.

The cover unit is completed with a flat top wall 74, with internal recesses 76 distributed over its surface. The recesses 76 may readily be opened to form aperture through the top wall so that fasteners can be passed through the apertures to secure the top of the cover unit to a horizontal surface, for example under a cupboard or the like.

The assembled container carries a roll 78 of plastic film 80. The roll has a tubular core 82 each end of which is mounted on an end plate 84 by a ring of bosses 86 projecting from the end plate. The end plates themselves are seated on edge on the base plate 44 and are retained in place by the pairs of ribs 88 formed on the top surface of the base plate 44 as shown most particularly in FIG. 7.

Figure 8:
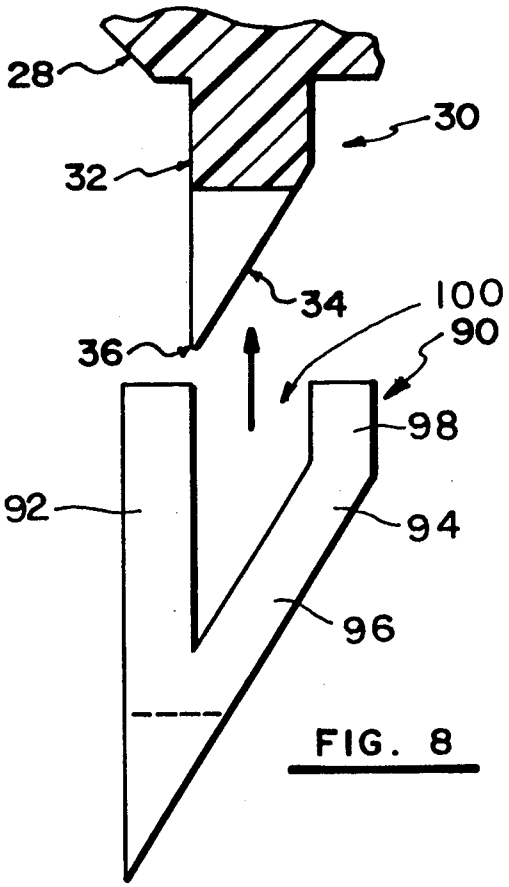
FIG. 8 is an end view of a replacement cutter.

FIG. 8 illustrates a replacement cutter for the dispenser. The replacement cutter 90 has a front flange 92 extending the full length of the replacement cutter and a rear flange 94 with an upwardly sloping bottom section 96 and a vertical upper section 98. The flanges define a channel 100 within the replacement cutter which matches the configuration of the original cutter 30 of the dispenser and clips onto the original cutter as shown in FIG. 8. The replacement cutter in the illustrated embodiment is a frictional fit on the original cutter 30. In other embodiments of the invention, it may be a snap fit, using beads or other formations for retention purposes.

The dispenser may be mounted on a horizontal surface as described above or on a vertical surface using fasteners through the key hole slots 72 in the back wall ribs 70.

When the dispenser is installed, the cover unit 16 is mounted on a wall or under a shelf or cupboard. The roll 78 of plastic film is fitted with the end plates 84 and placed on the base plate 4, where it is supported by the end plates.

Once the roll has been placed on the base unit, the end of the film is withdrawn from the roll and fed through the dispensing opening 46 behind the base plate. The complete base unit and film roll can then be lifted as a whole into the bottom of the cover unit 16. Because of their curved outer faces, the locking tabs 56 are cammed inwardly by engagement with the lower edge of the cover unit and walls. When the base unit is fully engaged, the locking tabs spring outwardly into the locking openings 62 to retain the base unit on the cover unit. The film may then be dispensed by drawing it down through the dispensing opening 46, across the bottom of the base plate 44 to be cut by the cutter 30 at the front of the base plate. The ribs 50 on the base plate and the roughened lower surface of that plate inhibit any clinging of the film to the base plate so that the length of film will normally drop down between the cutter and the front edge of the dispensing opening and will be readily available for grasping the next time that film needs to be drawn from the dispenser. In the case of very high static films, some clinging may occur, but the film will be easily separated from the base plate when desired. In most, if not all, such cases, the film will release by itself in a short time.

When a roll of film is exhausted, the base unit is easily removed from the cover unit by pressing on the locking tabs 56 to release from the locking openings 62, freeing the base unit to be removed.

In the embodiment described, each of the cover unit and the base unit is integrally molded from a thermoplastic material.

While one embodiment of the present invention has been described in the foregoing, it is to be understood that other embodiments are possible. The invention is to be considered limited solely by the scope of the appended claims.

We claim:

1. In combination, a dispenser for plastic film wrap and a roll of plastic film wrap exhibiting static cling properties, said plastic film being without a pressure sensitive adhesive coating, the dispenser comprising a container for housing the roll of plastic film wrap, the container having spaced front and rear walls and a base with spaced front and rear sides adjacent the front and rear walls respectively, a dispensing slot adjacent the rear side of the base and a film cutter adjacent the front side of the base, and roll mounting means mounting the roll of film in the container such that an end of the film may be withdrawn from the container through the dispensing slot and drawn across the base of the container for engagement with the cutter, wherein the base has an anti-static cling configuration including a bottom surface with a plurality of projections extending therefrom between the dispensing slot and the cutter.

2. A dispenser according to claim 1 wherein the projections are ribs.

3. A dispenser according to claim 2 wherein the ribs are substantially parallel to the dispensing slot.

4. A dispenser according to claim 2 wherein the ribs are substantially v-shaped in cross section.

5. A dispenser according to claim 2 wherein the bottom surface has a rough texture.

6. A dispenser according to claim 1 wherein the base comprises a synthetic plastic plate.

7. A dispenser according to claim 6 wherein the cutter is a synthetic plastic blade integral with the plate.

8. A dispenser according to claim 1 wherein the container comprises a cover unit and a base unit removably engageable with the cover unit.

9. A dispenser according to claim 1 wherein the bottom surface has a rough texture.

10. In combination a dispenser for plastic film wrap and a roll of plastic film wrap exhibiting static cling properties, said plastic film being without a pressure sensitive adhesive coating, the dispenser comprising a container for housing the roll of plastic film wrap, the container having spaced front and rear walls and a base with spaced front and rear sides adjacent the front and rear walls, respectively, a dispensing slot adjacent the rear side of the base and a film cutter adjacent the front side of the base, and roll mounting means mounting the roll of film in the container such that an end of the film may be withdrawn from the container through the dispensing slot and drawn across the base of the container for engagement with the cutter, the base having an anti static cling configuration including a bottom surface with a rough texture and a plurality of projections extending therefrom between the dispensing slot and the cutter, wherein the container comprises a cover unit, a base unit detachably engageable with the cover unit and latch means for engaging the base unit with the cover unit in response to movement of the base unit into engagement with an open bottom side of the cover unit.

11. A dispenser according to claim 10 wherein the roll mounting means are carried by the base unit.

12. A dispenser according to claim 10 including cover unit wall mounting means for mounting the cover unit on a wall.

13. A dispenser according to claim 10 including cover unit overhead mounting means for mounting the cover unit to the bottom of a horizontal surface.

14. A dispenser for plastic film comprising:

a housing for containing a roll of plastic film;

a dispensing opening along one side of the housing;

a first elongate cutter parallel to the dispensing opening and comprising a permanent part of the housing; and a second elongate cutter comprising a channel engageable over the first cutter for detachably mounting the second cutter on the first cutter for removal and replacement of the second cutter.

* * * * *